United States Patent [19]

Teshima et al.

[11] Patent Number: 4,852,633

[45] Date of Patent: Aug. 1, 1989

[54] IMMERSION NOZZLE FOR CONTINUOUS CASTING OF STEEL

[75] Inventors: Toshio Teshima; Tooru Kitagawa; Mikio Suzuki; Toshio Masaoka; Takashi Mori; Kazutaka Okimoto, all of Tokyo, Japan

[73] Assignee: NKK Corporation, Tokyo, Japan

[21] Appl. No.: 199,113

[22] Filed: May 26, 1988

[30] Foreign Application Priority Data

Jun. 1, 1987 [JP] Japan ..... 62-134940

[51] Int. Cl.[4] ..... B22D 11/10

[52] U.S. Cl. ..... 164/437; 164/337; 222/591

[58] Field of Search ..... 164/437, 438, 439, 415, 164/488, 489, 475, 337; 222/591, 603, 606, 607

[56] References Cited

U.S. PATENT DOCUMENTS 4,210,264 7/1980 Kondo ..... 222/591

FOREIGN PATENT DOCUMENTS 57-36045 2/1982 Japan ..... 222/603
58-9750 1/1983 Japan ..... 222/603
2081702A 8/1980 United Kingdom .

*Primary Examiner*—Richard K. Seidel
*Attorney, Agent, or Firm*—Frishauf, Holtz, Goodman & Woodward

[57] ABSTRACT

An immersion nozzle for continuous casting of steel comprises an immersion nozzle body for introducing molten steel supplied form a tundish into a continuous casting mold, the immersion nozzle body having two exit ports located symmetrically about a vertical center axis of the immersion nozzle body at a lower portion thereof and being immersed in the molten steel in the mold. The immersion nozzle body has a bore which includes first and second sectional areas, the first sectional area being at and below the two exit ports and being smaller than the second sectional area, the second sectional area being above the two exit ports, and the molten steel passing through the bore and out through the two exit ports. The bore has an inner diameter at the level of the two exit ports which is substantially equal to a horizontal inner length or diameter of the two exit ports. A ratio represented by (A)/(B) is from 0.5 to 0.8, where (A) is the area of the first sectional area and (B) is the area of the second sectional area.

4 Claims, 3 Drawing Sheets

IMMERSION NOZZLE FOR CONTINUOUS CASTING OF STEEL

BACKGROUND OF THE INVENTION

1. Field of the Invention

The present invention relates to an immersion nozzle for introducing molten steel from a tundish to a mold for continuous casting of steel, and more particularly to a structure of the immersion nozzle.

2. Description of the Prior Art

Deposit of oxide inclusions on the inwall of an immersion nozzle for continuous casting of steel increases as time goes by. This deposit restricts casting time of molten steel, builds deoxidized products of a few microns contained in molten steel and induces defects in steel products. An increase of the defect ratio of the products attributable to mold powder has also been ascertained in connection with the recent increase of continuous casting speed. This increase of the defect ratio is closely related with up and down movements of the surface level of the molten steel in the mold. The excess movement of the surface level of the molten steel over a certain level gives rise to the defects attributable to the mold powder. In the increase of the continuous casting speed, the up-and-down movements of the surface level of the molten steel are too difficult to be controlled in the range of the optimum levels and their results are remarkably reflected as the defects of the products. Properly speaking, the forms of the immersion nozzle need to be selected individually and elaborately depending on continuous casting speed and size of the slabs, because the movements of the surface level of the molten steel in the mold are determined by the flow speed and the flow direction of the molten steel poured from the immersion nozzle into the mold. However, the proceeding of the increase of the inclusions deposited on the inwall of the immersion nozzle varies the flow speed and the flow direction of the molten steel poured from the immersion nozzle into the mold as time goes by and often causes surface defects of the slabs attributable to the mold powder.

FIGS. 1(*a*)–1(*c*) show sectional views illustrating schematically a prior art immersion nozzle. FIG. 1(*a*) is a sectional plan view of an immersion nozzle body taken on line 2—2 of FIG. 1(*b*), passing through the centers of exit ports 12*a* and 12*b*. FIG. 1(*b*) is a vertical sectional view of the immersion nozzle body taken on line 3—3 of FIG. 1(*a*). FIG. 1(*c*) is a vertical sectional view of the immersion nozzle body taken on line 4—4 of FIG. 1(*a*). Prior art immersion nozzle body 11 has bore 13 (for passing the molten steel) inside the immersion nozzle and two exit ports 12*a* and 12*b* facing each other in the lower portion. The cross-sectional area of bore 13 is the same over the entire length of the nozzle. A horizontal inner length (i.e., diameter) of exit ports 12*a* and 12*b* are substantially the same as the diameter of bore 13. Alumina-graphite or zirconium is used for immersion nozzle body 11. Reference numeral 14 schematically shows inclusion deposited on and built up on the inwall of the immersion nozzle. The prior art immersion nozzle has difficulties in that the inclusion deposit on the nozzle inwall and the surface defects attributable to the mold powder occur.

SUMMARY OF THE INVENTION

It is an object of the present invention to provide an immersion nozzle having a structure, in which inclusions are not easily deposited on the inwall of the immersion nozzle.

In order to attain the object, in accordance with the present invention, an immersion nozzle for continuous casting of steel is provided, comprising: an immersion nozzle body for introducing molten steel supplied from a tundish into a continuous casting mold; said immersion nozzle body having two exist ports located symmetrically about the vertical center axis of said immersion nozzle body at a lower portion thereof, said immersion nozzle body being immersed in the molten steel of the mold and the two exit ports introducing the molten steel into the mold; said immersion nozzle body having a bore which includes two sectional areas, one of the two sectional areas at and below the two exit ports being smaller than the other sectional area above the two exit ports, through which bore the molten steel passes; and an inner diameter of the bore at the level of the exit ports having a length almost equal to a horizontal inner length of the exit ports.

The above object and other object and advantages of the present invention will become apparent from the detailed description to follow, taken in connection with the appended drawings.

DESCRIPTION OF THE PREFERRED EMBODIMENT

Relative to a prior art immersion nozzle, we, the inventors studied relations between casting time and thickness of alumina deposited on the nozzle, a flow speed of the molten steel inside the immersion nozzle and the thickness of alumina deposited on the nozzle inwall, and the amount of argon gas blown in the immersion nozzle and the thickness of alumina deposited on the nozzle inwall. As a result, the following were recognized.

Figure 1:
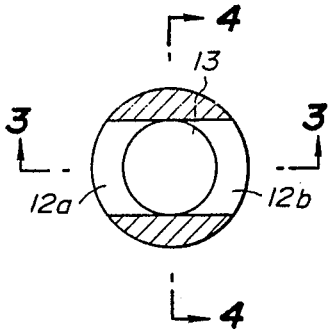
FIG. 1 (a) (Prior Art)
FIGS. 1 (*a*)–1(*c*) show sectional views illustrating a prior art immersion nozzle for continuous casting of steel.
Figure 1:
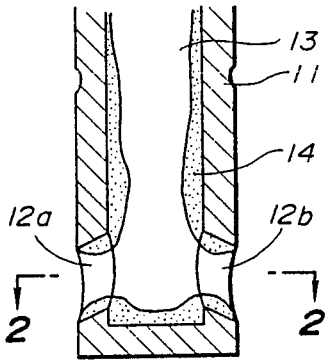
FIG. 1 (b) (Prior Art)
Figure 1:
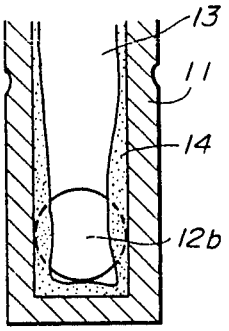
FIG. 1 (c) (Prior Art)

(A) In the direction of the vertical section of immersion nozzle body 11 taken on line 3—3 of FIG. 1(*a*), the thickness of alumina deposited is decreased by changing the materials of the immersion nozzle body from alumina-graphite into zirconium by increasing the flow speed of the molten steel inside the immersion nozzle body and by increasing the amount of argon blown in the immersion nozzle body.

(B) In the direction of the vertical section of immersion nozzle body 11 taken on line 4—4 of FIG. 1(*a*), the thickness of alumina deposited on the nozzle inwall is not decreased because the stagnation of the flow of the molten steel exists, even if the materials for the immersion nozzle body are changed from alumina-graphite to zirconium, the flow speed of the molten steel is increased inside the immersion nozzle body and the blow amount of argon into the immersion nozzle body is increased.

(C) The deposit of the inclusions on the inwall of the immersion nozzle body in the vertical direction taken on line 4—4 of FIG. 1(*a*) does not proceed further when the inclusions are deposited on the nozzle inwall to a certain extent. This is because the stagnation of the flow is decreased as the deposit of the inclusions goes on in the vertical direction of the immersion nozzle body.

Based on the above-mentioned knowledge, the deposit of the inclusions in the vertical direction of the immersion nozzle body taken on line 4—4 of FIG. 1(*a*) proved to be the same as that in the vertical direction of the immersion nozzle body taken on line 3—3 of FIG. 1(*a*), when the form of the immersion nozzle body in the vertical direction was shaped so that the molten steel could not become stagnant.

The present invention removes the stagnation in the flow of the molten steel by reducing a sectional area of a bore at and below the two exit ports to less than that above the exit ports. Furthermore, the stagnation in the flow of the molten steel is reduced by making an inner diameter of the bore at the level of the exit ports almost equal to a horizontal inner length of the two exit ports located symmetrically about the vertical axis of the immersion nozzle.

Figure 2:
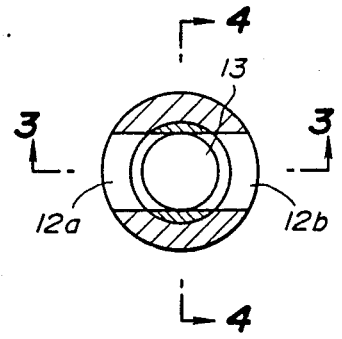
FIGS. 2 (*a*)–2(*c*) show sectional views illustrating an immersion nozzle for continuous casting of steel of the present invention.
Figure 2:
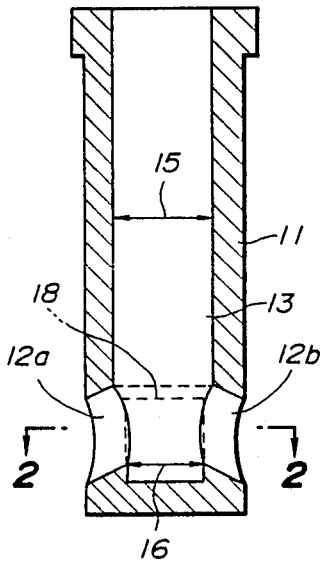
Figure 2:
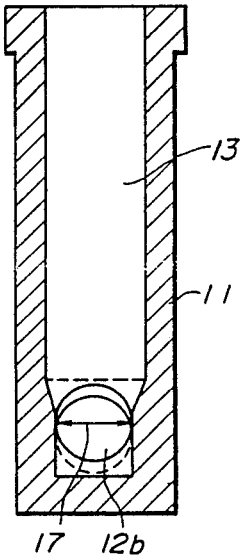

FIGS. 2(*a*)–2(*c*) show sectional views illustrating an immersion nozzle for continuous casting of steel of the present invention. FIG. 2(*a*) is a sectional plan view of the immersion nozzle body 11 taken on line 2—2 of FIG. 2(*b*), passing through the centers of exit ports 12*a* and 12*b*. FIG. 2(*b*) is a vertical sectional view of immersion nozzle body 11 taken on line 3—3 of FIG. 2(*a*). FIG. 2(*c*) is a vertical sectional view of the immersion nozzle body taken on line 4—4 of FIG. 2(*a*).

Immersion nozzle body 11 is made from refractory and is provided with exit ports 12*a* and 12*b* located symmetrically about the vertical center axis of the immersion nozzle body at its lower portion. Exit ports 12*a* and 12*b* are circular in shape. The bottom of the immersion nozzle body is of a pool shape.

When exit ports 12*a* and 12*b* are opened, inner diameter 16 of the section of the bore 13 for flowing the molten steel at and below the exit ports is designed to be equal to a horizontal inner length 17 (FIG. 2(*c*) of the exit ports. The bore centers of exit ports 12*a* and 12*b* are directed upwardly relative to a horizontal plane to the vertical center axis of the immersion nozzle. The exit ports 12*a*, 12*b* thus have a center axis with an angle sloping upwards relative to the horizontal line. Furthermore, a line passing through the centers of exit ports 12*a* and 12*b* crosses lower end 18 of a reduced diameter portion at the lower end of the immersion nozzle body.

Figure 3:
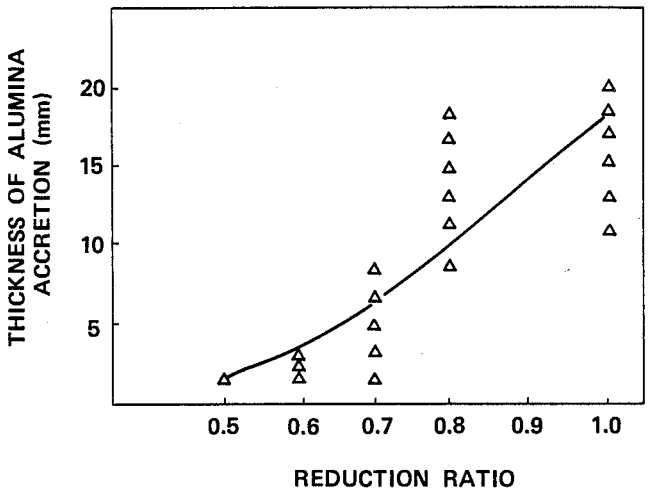
FIG. 3 is a graphic representation indicating the relation between the reduction ratio represented by (A)/(B) and thickness of alumina deposited on a nozzle inwall when the immersion nozzle of the present invention is used, where (A) is a sectional area of a bore at and below two exit ports and (B) is that above the two exit ports.

FIG. 3 is a graphic representation showing the relation between reduction ratio represented by (A)/(B) and the thickness of alumina deposited on the nozzle inwall, (A) being a sectional area at and below the exit ports and (B) being a sectional area above the exit ports. Casting conditions are shown below in the case of the reduction ratios being 0.5, 0.6, 0.7 and 0.8:

Inner diameter 15 of the bore at and below the exit ports: 75–85 mm

Inner diameter 16 of the bore above the portion of the exit ports: 50–65 mm

Casting speed: 1.0–5.0 Ton/min.

Casting time: 150–250 min.

Material of the immersion nozzle body: zirconium lined with alumina-graphite.

The case where reduction ratio of (A)/(B) is 1.0 is given for an example of using the prior art immersion nozzle.

From FIG. 3, it is recognized that 0.5 or more and 0.8 or less of the reduction ratio is preferable. If the reduction ratio is less than 0.5, solidified metal stops us at the exit ports and therebelow at the beginning stage of casting and the immersion nozzle is easily choked. If the ratio is over 0.8, the deposit of alumina inclusions is increased. The reduction ratio (A)/(B) ranges most preferably from 0.55 to 0.7.

Figure 4:
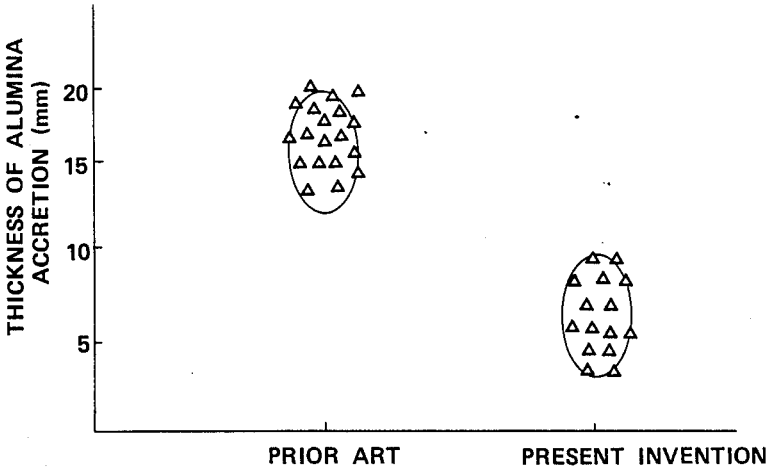
FIG. 4 is a graphic representation indicating the comparison of thickness of alumina deposited on the inwall of an immersion nozzle at the time of using the immersion nozzle for continuous casting of steel of the present invention with that of alumina deposited at the time of using a prior art immersion nozzle for continuous casting of steel.

In FIG. 4, the thickness of alumina deposited on the inwall of an immersion nozzle of the present invention is compared with that of a prior art immersion nozzle. The thickness of alumina deposited on the inwall according to the present invention reduced to one third of the thickness of alumina deposited on the nozzle wall according to the prior art method. In this example, exit ports of a circular shape and a pool-shaped bottom portion of the immersion nozzle were used, but the shapes of the exit ports and of the bottom portion are not necessarily limited to those mentioned above. A rectangle-shaped or oval exit port and a convex bottom portion can be also used.

According to the immersion nozzle of the present invention, used in the continuous casting of steel, the stagnation of the molten steel inside the immersion nozzle, more particularly, at the portion of the exit ports and in the vicinity thereof is removed and the thickness of alumina deposited on the inwall of the immersion nozzle can be reduced. As a result of the reduction of the thickness of alumina deposited on the nozzle inwall, the quality of slabs and final products can be improved.

We claim:

1. An immersion nozzle for continuous casting of steel, comprising:

an immersion nozzle body for introducing molten steel supplied from a tundish into a continuous casting mold;

said immersion nozzle body having two exit ports located symmetrically about a vertical center axis of said immersion nozzle body at a lower portion thereof, said immersion nozzle body being immersed in the molten steel of the mold and the two exit ports introducing the molten steel into the mold;

said immersion nozzle body having a bore which includes a first and a second sectional area of the two exit ports, the first sectional area being smaller than the second sectional area, the first sectional area being at a lower end level of said two exit ports and the second sectional area being at an upper end level of said two exit ports, and the molten steel passing through said bore and out through said two exit ports; and said bore having, at the level of said two exit ports, an inner diameter which is substantially equal to a horizontal inner length of said two exit ports.

2. The immersion nozzle according to claim 1, wherein the first sectional area is represented by (A), the second sectional area is represented by (B), and wherein a reduction ratio represented by (A)/(B) is between 0.5 and 0.8.

3. The immersion nozzle according to claim 2, wherein said reduction ratio of (A)/(B) is between 0.55 and 0.7.

4. The immersion nozzle of claim 1, wherein said inner diameter of said bore is equal to a horizontal inner length of said two exit ports.

* * * * *